US005630899A

United States Patent [19]

Meschi

[11] Patent Number: 5,630,899

[45] Date of Patent: May 20, 1997

[54] MAIL PARCEL SEALING METHOD AND APPARATUS

[75] Inventor: Luciano Meschi, Castiglioncello, Italy

[73] Assignee: Industria Grafica Meschi SRL, Livorno, Italy

[21] Appl. No.: 526,195

[22] Filed: Sep. 11, 1995

Related U.S. Application Data

[63] Continuation of Ser. No. 353,151, Dec. 9, 1994, abandoned, which is a continuation of Ser. No. 899,504, Jun. 16, 1992, abandoned.

[30] Foreign Application Priority Data

Jun. 17, 1991 [IT] Italy ..... MI91A1654

[51] Int. Cl.[6] ..... B31F 5/04

[52] U.S. Cl. ..... 156/217; 156/227; 156/291; 156/297; 156/305

[58] Field of Search ..... 156/217, 227, 156/244.72, 291, 297, 305, 441.5, 442.1, 575, 578

[56] References Cited

U.S. PATENT DOCUMENTS

| | | | |
|---|---|---|---|
| 1,545,217 | 7/1925 | Thurber | 281/18 |
| 1,593,148 | 7/1926 | Thurber | 281/18 |
| 1,897,038 | 9/1933 | Bohmert | 281/21.1 |
| 2,168,920 | 1/1939 | Wissmann | 229/92.8 |
| 3,152,800 | 10/1964 | Hanson . | |
| 3,837,565 | 9/1974 | Johnsen | 229/69 |
| 3,981,435 | 9/1976 | Johnsen . | |
| 4,077,831 | 3/1978 | Snellman et al. | 156/578 |
| 4,091,596 | 5/1978 | Jones . | |
| 4,116,750 | 9/1978 | Lewis et al. | 156/578 |
| 4,343,129 | 8/1982 | Gunther, Jr. et al. . | |
| 4,575,121 | 3/1986 | Conti | 229/92.3 |
| 4,817,990 | 4/1989 | Krost | 283/101 |
| 5,167,739 | 12/1992 | Hutchinson et al. | 156/291 |

FOREIGN PATENT DOCUMENTS

| | | |
|---|---|---|
| 0421565 | 10/1991 | European Pat. Off. . |
| 375353 | 7/1907 | France . |
| 2418717 | 9/1979 | France . |
| 247461 | 3/1947 | Switzerland . |

OTHER PUBLICATIONS

Moore Paragon Brochure, "PostMatic 830", Feb. 1979.

Moore Paragon Brochure, "An Introduction to Pressure Seal," Oct. 1990.

*Primary Examiner*—Michael W. Ball

*Assistant Examiner*—Richard Crispino

*Attorney, Agent, or Firm*—McAulay Fisher Nissen Goldberg & Kiel, LLP

[57] ABSTRACT

Printed matter in form of single sheets or groups of sheets is converted into a sealed cover or parcel ready for mailing by glueing along all perimetral edges of the cover or parcel, in which a folding operation has been possibly previously carried out in order to form the size of a standard envelope for mailing.

10 Claims, 9 Drawing Sheets

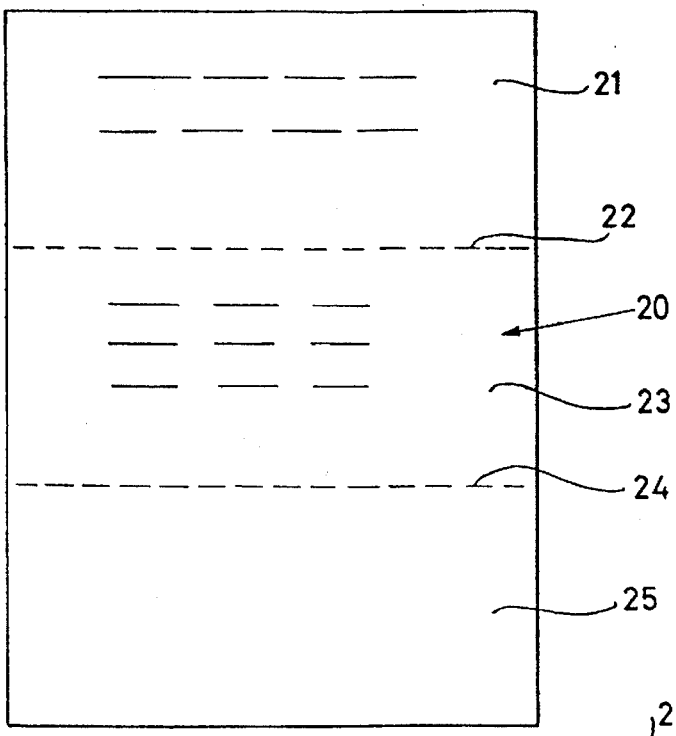
Fig.9
PRIOR ART
Fig.13
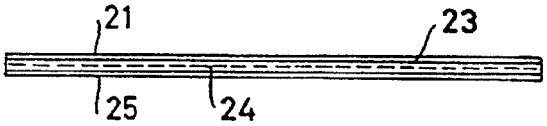
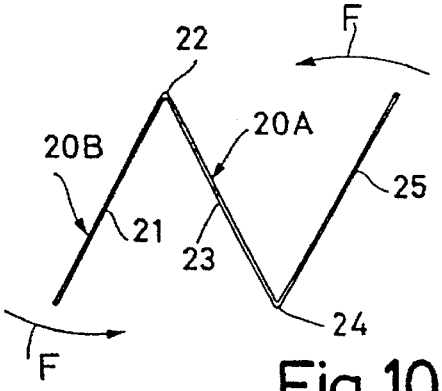
Fig.10
Fig.14
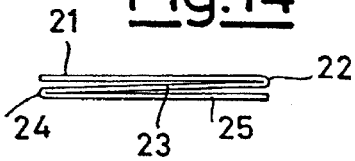
Fig.15
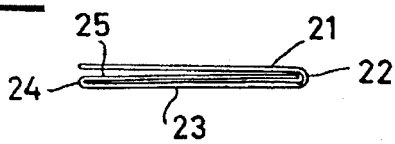
Fig.11
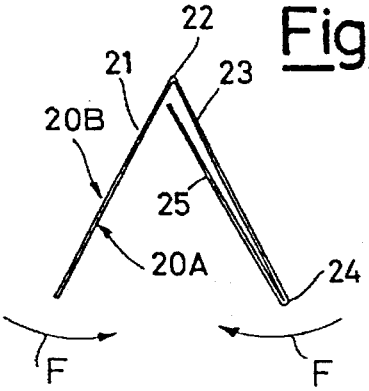
Fig.12
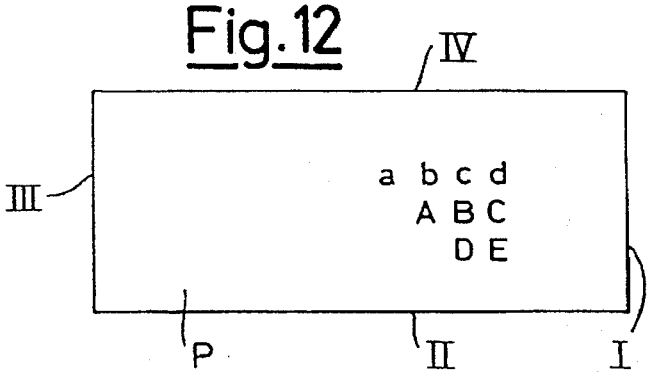

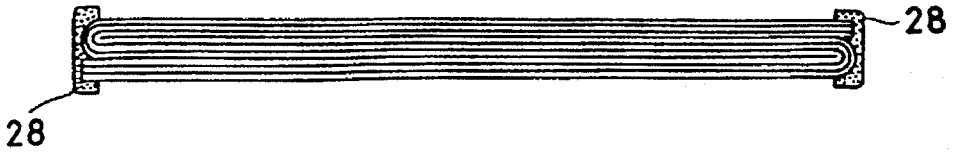
Fig.16
Fig.17
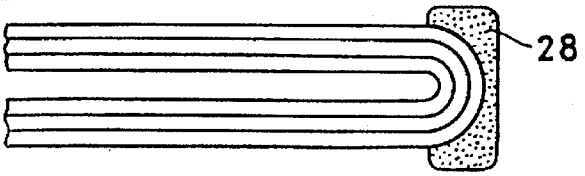
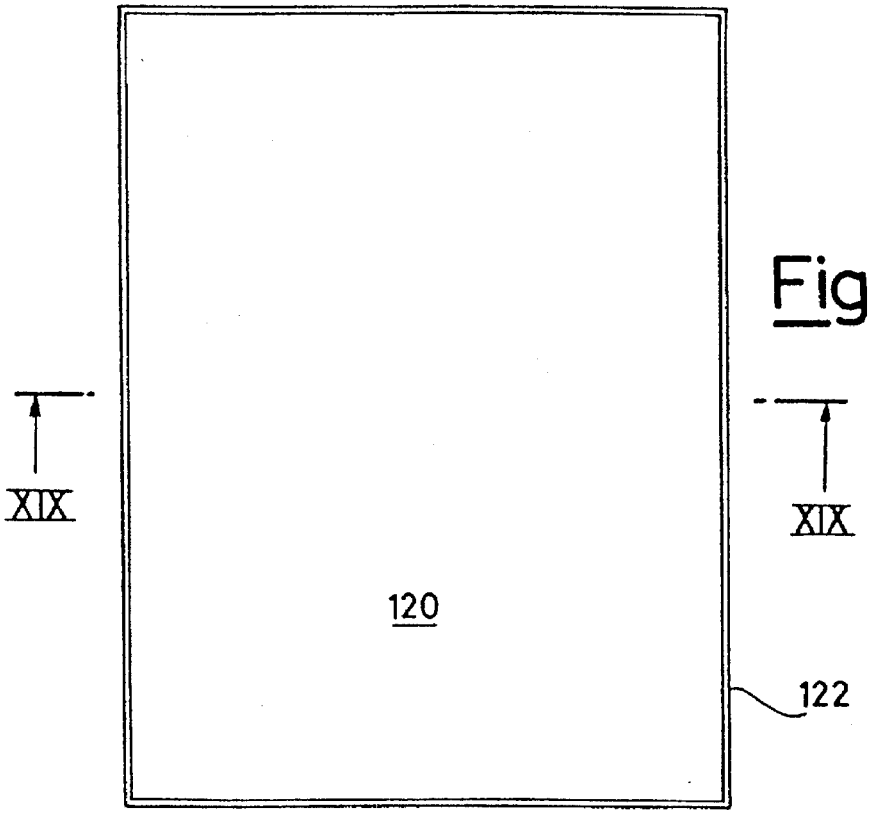
Fig.18
Fig.19
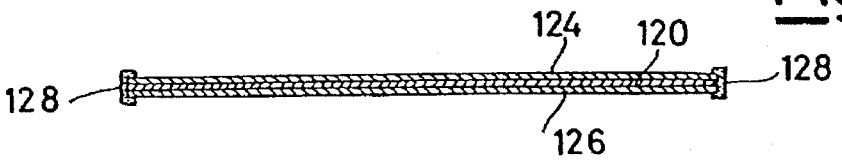

MAIL PARCEL SEALING METHOD AND APPARATUS

This is a continuation of application Ser. No. 08/353,151 filed Dec. 9, 1994, now abandoned, which is a continuation of Ser,. No. 07/899,504 filed Jun. 16, 1992, now abandoned.

BACKGROUND OF THE INVENTION

1. Field of the Invention

The present invention relates to side sealing of covers consisting of a number of paper sheets, particularly to prepare for mailing.

In the following description specific reference shall be made to mailers, i.e. mail shipping covers or parcels and, it should not be construed in a limiting sense about the scope of the present invention, since the sealed covers produced by the method and apparatus of the present invention may be provided for different uses.

2. Description of the Prior Art

It is known that, besides the normal mailing system in which the printed matter in the form of sheets which is to be mailed is enclosed into an envelope which in turn is sealed either totally or partially at an open side for the introduction of the aforesaid printed matter, different systems have heretofore been proposed and adopted especially in connection with the exceedingly wide and capillary diffusion of the so-called continuous forms and of the fast printing, for example in laser printing centers.

In this case, as a matter of fact, the form is also called a "self-enveloping sheet" and has parts which were previously glued; when the printing has been completed, a folding is carried out according to predetermined folding lines and the sealing takes place preferably by activating the glue, for example by the provision of heat which causes the previously provided glue to be reactivated.

In this second case, obviously, it is necessary to have suitably punched and pre-glued sheets or forms, which are useful only for specific uses: typical examples are the payment forms issued from public or private companies supplying services such as phone services, electrical supply services, portable water supplies, etc.

In these cases the requirement imposed by the public mail service, namely the accessibility to the content of the covers for the possible postal inspection (as a matter of fact, usually these are mailings carried out at a special tariff) makes it unavoidable, not only to shape the punched sheet so as to fulfill this requisite, but also to use the so-called reversible glues, permitting the opening and the reclosing of the cover.

However there are several cases, which as a matter of fact are the majority, in which the printed material to be mailed consists of a paper sheet of the conventional type and size, but, in particular, those cases in which a certain number of different sheets constitutes the material to be transmitted to the addressee. In this case the only solution is still that of the conventional envelope of the above-mentioned type.

A typical example is that of the transmission of bank statements of account, which for most cases and customers, consist of a certain number of subsequent sheets. Another example consists of the transmission by the aforesaid service supplying companies of documents supporting the figures debited based on the payment of bills.

This problem is particularly serious when the documents to be transmitted (for example in the typical case of bank statements of account) are processed and printed at a very high operational rate, which in the above cited example uses computerized accounting centers and laser printers operating at a high speed (of the order of 80 cm/sec.); folding along predetermined folding lines is also carried out mechanically and is made automatic. However, the introduction of the documents into the envelopes causes the whole operation to be slowed down in an untolerable measure, sometimes making it almost superfluous and making it necessary to resort to more and more sophisticated and faster acting apparatus.

Of course, the separated envelopes cause greater expenses not only due to their intrinsic cost, but also owing to the greater weight as a result of the increased weight of the covers to be mailed and this increased weight is reflected in the mailing costs which as a matter of practice and almost universally are unequivocally dependent on the weight of the letter to be mailed.

SUMMARY OF THE INVENTION

It is the main object of the present invention to provide a solution of the aforesaid problem, which is industrially feasible and economically advantageous.

A most specific purpose of the present invention is that of providing a method and an apparatus to enable the sealed covers to be shipped or mailed without the use of a separate envelope.

These and other purposes are attained by the present invention through a method and an apparatus for the sealing of covers particularly ready for the mail shipping.

Thus the method according to the present invention in the most general definition thereof is characterized in that the cover to be sealed for the mailing, the edges of which are defined by at least two paper sheets or two parts of only one sheet matching to each other, is sealed by glueing along all four sides of the cover.

According to a first embodiment, the method of the invention contemplates the steps of (a) folding of each sheet along folding lines perpendicular to the side thereof having the greatest length for a number of times such that at least two contiguous sections starting from one end of the sheet have a size corresponding to or consistent with those of an envelope which is usually accepted by the postal service, the other sections having a size less than that of said at least two contiguous sections and (b) glueing along the four sides of the above individuated sections so that the glue involves all of the sheet edges forming each of said sides, said glue being applied in situ or previously provided along all edges of the starting paper sheet, provided that in this second case the glue is of a type consistent with the handling which the sheet previously undergoes and is activatable at the time of the aforesaid sealing.

According to a second embodiment of the method of the present invention the covers to be sealed consist of a non-folded first sheet having on at least one surface thereof the information to be communicated to the addressee which is covered by a second sheet matching with the first unfolded sheet along all edges, whereafter sealing along all side edges or sides of the second sheet forming the thus defined cover is carried out.

According to a modification of this second embodiment said information bearing sheet is enclosed between two protecting sheets having like size, the aforementioned glueing along all sides or side edges is carried out.

According to a further embodiment of the method of the present invention said glueing along the four sides or edges of the cover to be sealed and shipped is carried out by means of a support such as for example a ribbon coated with the sealing glue engaging with a U-shaped, part the side of the cover to be sealed, said shaping being preformed in said ribbon or realized at the sealing time.

In turn the apparatus according to the present invention for the embodiment of the above defined method comprises in its most general form guide means for the guided carrying or conveying of the parcels or covers of sheets to be sealed together, a number or plurality of glue sealing stations, each corresponding to one side of said parcel or cover, said station being positioned in an ordered series so that said conveying or carrying means present at each station the side for which the sealing by glueing is desired, and glue sealing means at each station for the sealing by glueing.

According to a first embodiment of the apparatus of the present invention, in which the glue is applied in situ to the four sides or edges of the packages or covers or parcels to be sealed, said conveying or carrying means consist of roll frame in which each parcel or cover or package to be sealed is carried on or moved by a belt or ribbon or tape carrying means, stopping at each glue application station for smearing glue.

The glue, in turn, is applied or smeared by means of conical roller applicators, drawing it from a corresponding basin containing the glue in liquid form suitable for the application or smearing whereas downstream of each applying station there are preferably foreseen fan means or ventilation means for the drying of the applied glued smeared immediately upstream.

Alternatively, the application of the glue at each side or the smearing of the glue at the corresponding metering station is carried out by means of glue applying nozzles, the glue being sufficiently liquid, said nozzles being fed by corresponding supplying means for the dosed supplying of glue in the aforementioned conditions.

In the embodiment in which the glue is not applied in situ, the sealing means consist of means for the reactivation or softening of a thread or seam of glue previously applied to the four sides of each paper sheet so as to coat or cover the corresponding edge of the sheet, possibly extending for a minimum distance towards the inside of the sheet.

In this case, obviously, the reactivating means or softening means strictly depend on the type of glue: for example if it is a glue adapted to be hot reactivated, the reactivating means are adapted to apply a dosed quantity of heat to the adjacent side of the cover and thus partially or totally liquefy the glue which subsequently becomes solid owing to the cooling, giving rise to the desired sealing effect.

According to a variation of this embodiment said thread or seam of glue, instead of the glue being applied to the four sides or edges of the paper sheet, it is applied to a ribbon like support, preferably U-shaped, which is applied along the edges to be sealed, after which a reactivation of the glue is carried out as in the previously stated manner. In this case, by the way, the single sheet must be folded as set forth in the previously indicated manner or the parcel must contain at least one and preferably two protection sheets for the sheet (sheets) bearing the information to be transmitted to the addressee.

As it will be appreciated from the following detailed description, the method and apparatus of the invention are based on a technique which to date has been only tested and used in the book binding field, namely to obtain a firm joint between a number of superimposed and matching sheets by coating with glue only the paper of the sheet parcel.

As it is well known, in this manner the sheets are kept firmly together without having the glue interfere with the surface or the faces of the single sheet.

When the sheets are to be separated from each other it is enough to apply a separation or tearing action which takes place only at the edges glued to each other, (as it occurs for example in the case of the so-called note books).

BRIEF DESCRIPTION OF THE DRAWINGS

The peculiar features and advantages of the present invention shall appear more clearly from the following detailed description, made with respect to the attached drawings, in which:

FIGS. 9 to 15 show the different sealing operating phases referred to a paper sheet;

FIGS. 10 and 11 show a Z-fold and a C-fold respectively;

FIGS. 16 and 17 illustrate, in side view and in a partially enlarged detail view, respectively, the case of a number of sheets to be sealed in the form of a parcel for mailing; and FIGS. 18, 19 and 20, 21 show two particular modified embodiments of the method according to the present invention.

DETAILED DESCRIPTION OF THE PREFERRED EMBODIMENTS

Figure 1:
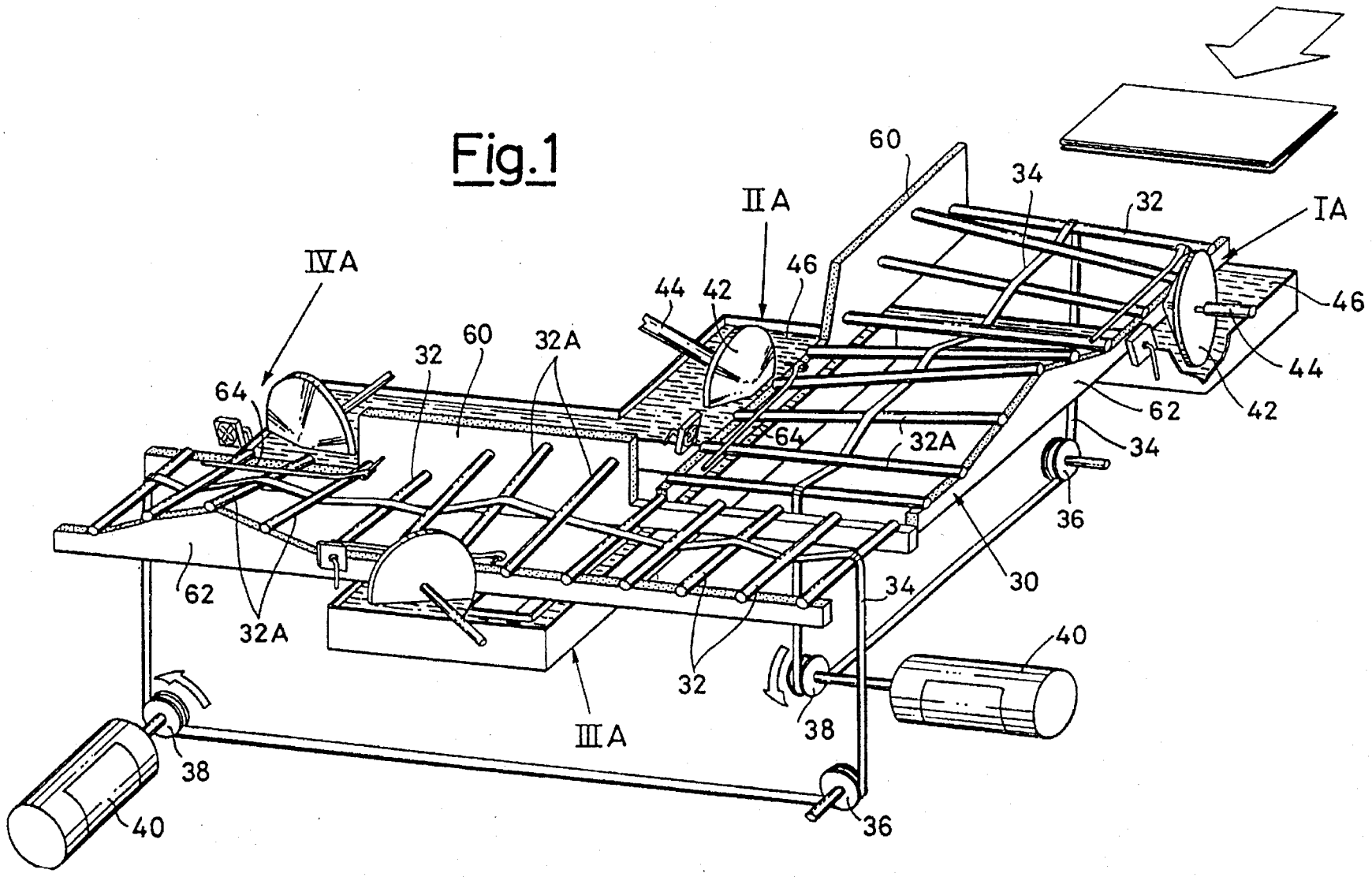
FIG. 1 is a perspective schematic view of a first embodiment of the apparatus according to the present invention.

For sake of clear disclosure, what is shown in FIGS. 9 to 15 will be initially discussed and explained in connection with the method of the present invention.

FIG. 9 shows a paper sheet, for example a letter paper sheet, indicated by the reference 20 and thus having one or an obverse face 20A and another or a reverse face 20B in FIG. 11. On this sheet there are indicated by dashed lines 22 and 24 (FIG. 9) two folding lines corresponding to the common lines along which a sheet of letter paper is folded before the introduction or insertion into a normal or conventional rectangular envelope for the mailing. As shown in FIGS. 10, 11, 14, and 15, the perimeter edges of the sheet and the fold lines form sides to which the glue is applied.

In FIGS. 10 and 11 two different manners or ways are represented to which the sheet 20 may be folded along the lines 22 and 24; the arrows F in the two figures represent the passing direction of the sheet to be folded in order to bring it into the flat configuration corresponding to that in which it is, in a superimposed configuration, contained in an envelope consistent with the standard size for mailing.

In the folding represented in FIG. 10 the sheet 20 is Z folded whereby for carrying out the method of the present invention the written communication to be transmitted to the addressee must be contained on the two areas 21 and 23 of the three areas (the third one being the area 25), in which these lines divide, even just ideally, the height or the longest sides of the sheet 20.

In the area 25 the address of the addressee is to be written and, if desired, also that of the sender (as sometimes it is made by placing the address of the sender in the upper left-hand part of the normal envelopes).

In the case of FIG. 11, on the contrary, the whole height or length of the face 20A is useful for the aforesaid written communication, whereas the addressee's address (and possibly the return address of the sender according to the already mentioned mode) must be written or printed on the face 20B forming the outer portion and suitably at the areas or outer faces 21 or 23.

When the movement indicated by the arrows F is completed up to the point at which the folded sheet is completely flattened, it is in both cases in the condition illustrated or shown in FIG. 12 and sidewise in the condition of the FIGS. 13 and 14 in the case of FIG. 10, whereas the side view in the case of FIG. 11, is that shown for sake of simplicity only by FIG. 15.

From FIG. 12 it is clearly seen that the sealing by glueing must involve all four sides I, II, III and IV.

The present invention thus contemplates that the sheet 20, folded into the final condition of FIG. 12, is glued along the four above said sides to maintain the edges in aligned condition, thus defining a mailer completely sealed on four sides ready and suitable for mailing.

Of course in the case or situation in which a number of sheets are to be sent together, which constitutes also the case that up to date has not found a different solution apart from the use of the conventional envelope, the phases or steps are similar except that two possibilities exist, namely that consisting in folding each sheet in the illustrated manner, and then superimposing the sheets in a flattened condition and then carrying out the glueing.

The other possibility, which is advisable especially when the sheets to be sent together are really three or four, is that of having the spread sheets matching or acting together and to proceed firstly to the folding and then to the sealing of the assembly of folded sheets.

Thus, in the case of the folding illustration in FIGS. 14 and 15 the cover P consists of only two folded sheets, whereas in the case of the folding illustration in FIGS. 16 and 17 the sheets forming the cover are three and are shown in the folded and sealed condition; in that case the reference numeral 28 indicates the glue thread or frame by means of which all the sheets are kept together in a sealed condition.

Figure 2:
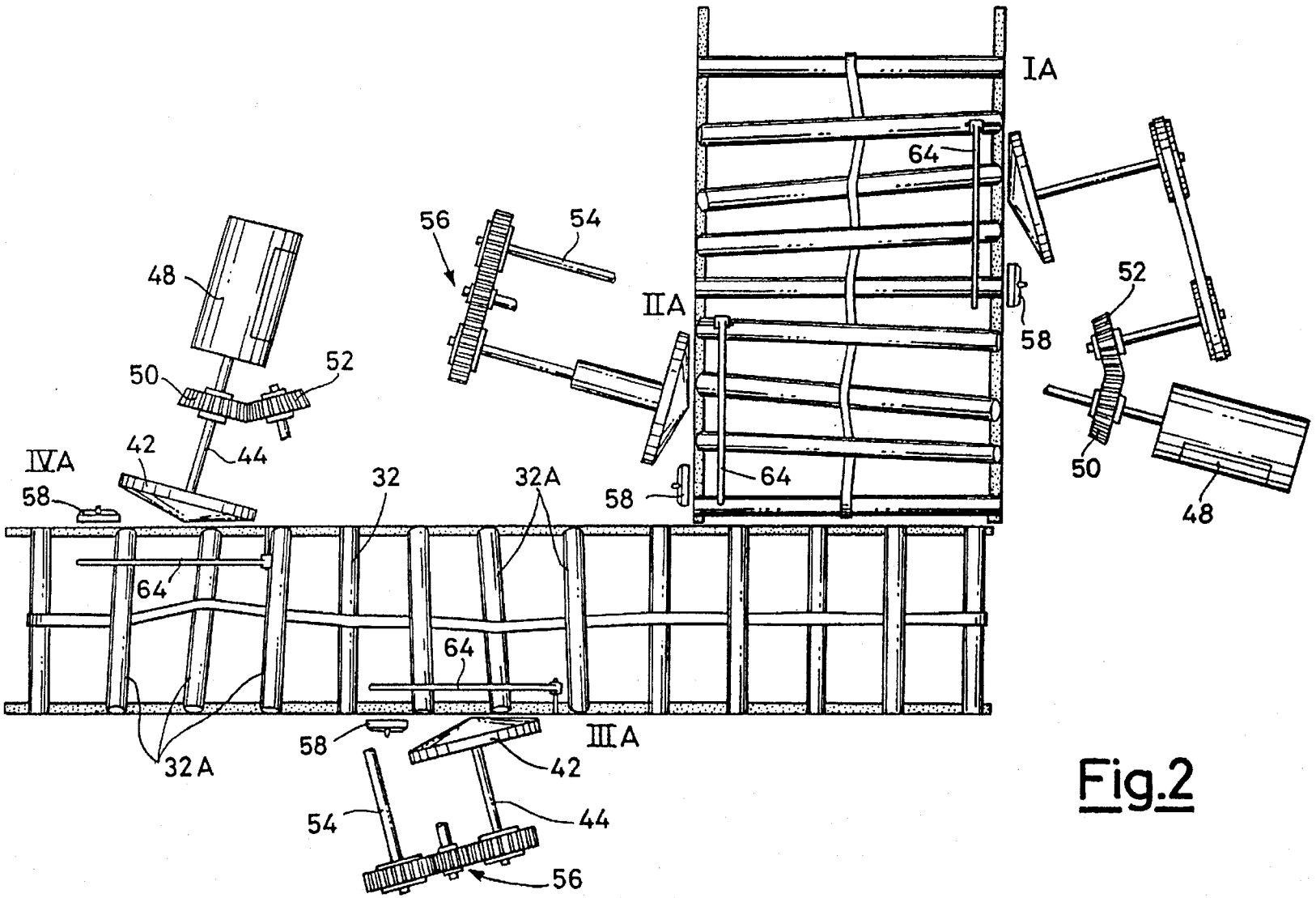
FIG. 2 is a plan view, also necessarily schematic, of the apparatus of FIG. 1.

Referring now more particularly to FIGS. 1 and 2 a first embodiment is shown of the apparatus according to the present invention comprising a frame 30, shown in schematic and essential form, whereby it is meant that the same, as well as the other mechanical components which will be described hereinafter, can be completed from the structural and mechanical point of view at the time of manufacturing thereof.

On the two upper surfaces of the frame 30 there is provided an operating plane for translation or movement of translation the parcels or covers to be sealed, this plane comprising a number of rollers or cylinders 32 idly mounted for pivotal movement at their two ends; of these cylinders those indicated by the reference numeral 32A, are placed at the four sealing stations, indicated by the reference numerals IA, IIA, IIIA and IVA, have longitudinal axes inclined with respect to the horizontal plane so as to promote the displacement of the parcel or cover being processed towards the glue applying device provided in each station.

For the controlled rotation of the rollers or cylinders 32 and 32A around their axes there is provided at least one belt 34 having it operating or upper reach passing alternatively above and under the rollers or cylinders 32 and 32A which are thus rotated by friction.

The belt 34 forms a closed ring thanks to an idle pulley 36 and to a driving or operating pulley 38 mounted at the end of the motor shaft of a motor 40, for example of the stepping kind, which causes the pulley 38 and consequently, through the belt 34, the rollers 32 and 32A to be rotated intermittently.

By the way, instead of the belt 34, equivalent motion transmission means can be used such as for example a chain and pinion transmission mounted at the head end or at one end of the rollers or cylinders 32 and 32A, possibly externally with respect to the cover transfer plane.

In FIG. 1 it is observed that the apparatus really comprises two horizontal transfer planes for the parcels or covers to be sealed, orthogonally positioned to each other and each of which serves two sealing stations, whereby also the driving in rotation of the idle rollers or cylinders 32 and 32A takes places by means of two separated belts (one for each plane) 34, having the respective motor 40 and pulleys 36 and 38. At each sealing station a glue applying device is provided comprising a conical head 42 mounted on an axis 44 driving into rotation by controlled motor means (shown in FIG. 2) comprising a motor 48 serving the two different conical heads 42 of two subsequent stations, namely IA and IIA as well as IIIA and IVA, through a transmission comprising the two pinons 50, 52, the transmission shaft 54 and the line transmission group 56.

Each conical head 42 is mounted so that, during the rotation, it is periodically dipped into a basin 46 containing the desired glue in the liquid state or with a controlled fluidity; it is for example obtained in a known manner by having the basin 46 provided with suitable means for the controlled heating and thermal regulation thereof.

The axis 44 of each conical head is mounted with a certain inclination with respect to the advancing direction of the parcels or covers, namely with respect to the line perpendicular to the adjacent transfer plane, so that the conical surface of the conical head 42 is practically almost tangent to the adjacent side of the frame.

In FIG. 2 this arrangement is clearly shown mainly as regards the position of the glue applying conical heads.

Each station is furthermore provided with quick drying means, represented for example by the fans 58.

It is lastly to be observed that in the shown embodiment for the mounting of the rollers 32A in an inclined position there are alternately foreseen supporting side plates 60 and relieved parts 62 formed onto the upper plane of the frame 30.

The operation of this embodiment is shown in the succession of it phases in the FIGS. 3 to 7, each of which shows the parcel or cover to be sealed at a specific station. It is evident that in the real operation each station shall be operating simultaneously to the others, whereby it is sufficient to adjust the advancing speed of the belts 34 and thus the rotation speed of the rollers or cylinders 32 and 32A so that each cover arrives at a station when the sealing in the same station of the desired side of the immediately previous cover, which has already abandoned this station, has been completed.

Figure 3:
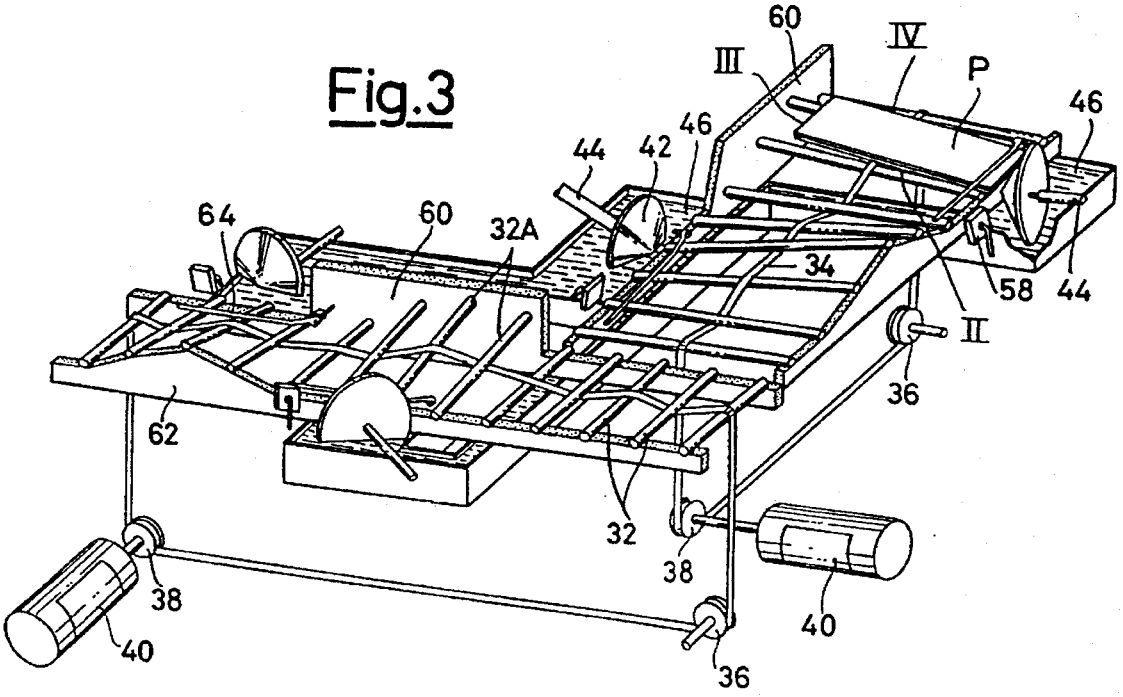
FIGS. 3, 4, 5 and 6 are views like FIG. 1 showing the four operating phases for the sealing of a parcel or cover of sheets.
Figure 4:
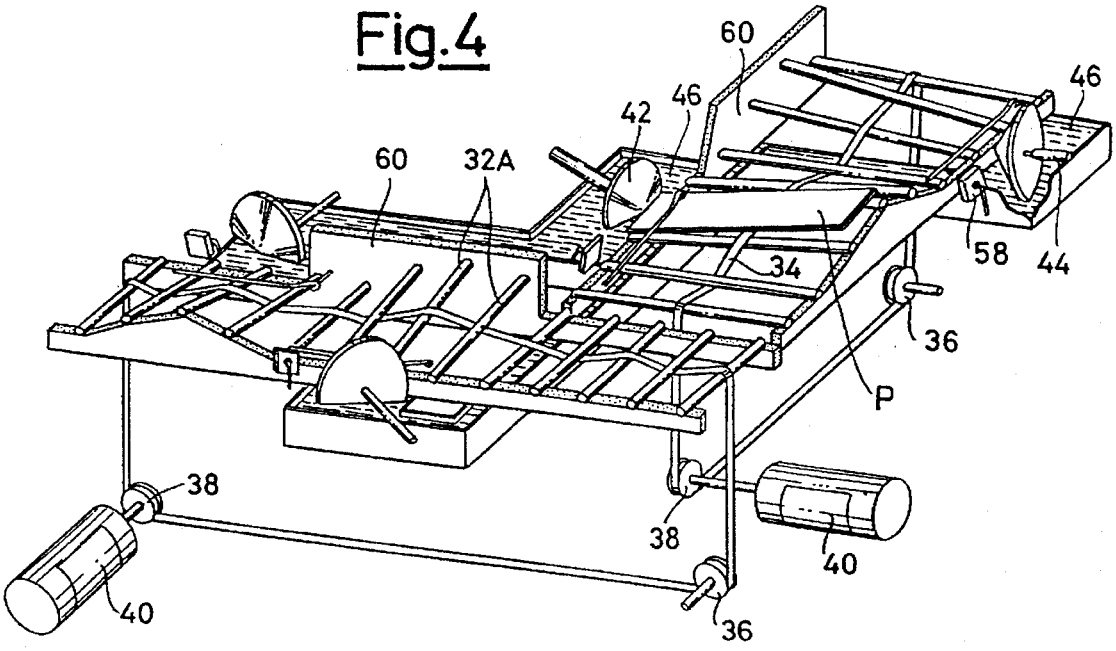
Figure 5:
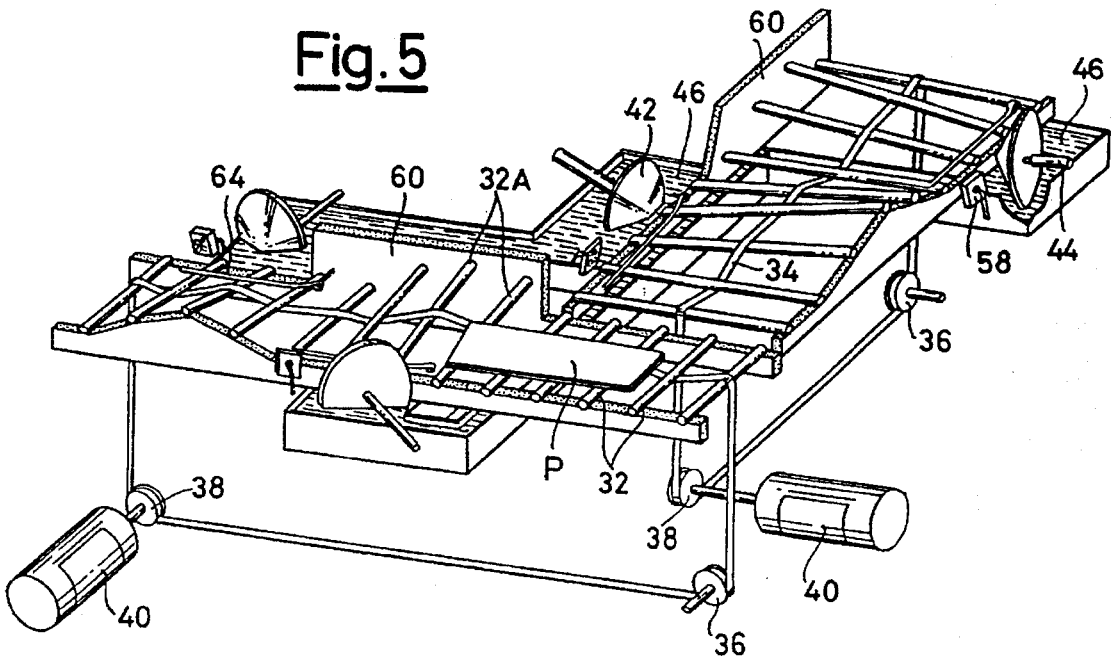
Figure 6:
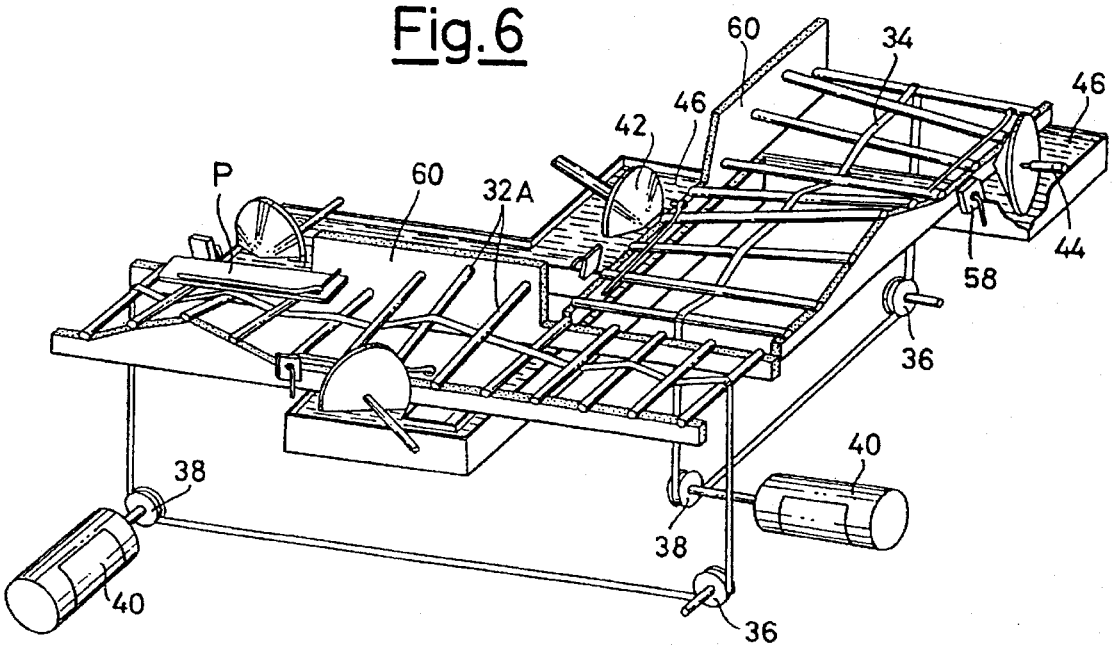

Starting from FIG. 3, the folded cover of FIG. 13, generally indicated with the reference P is brought with its side I into contact with the corresponding conical head 42 which upon rotation draws the glue from the basin and brings it upwardly until the aforesaid side I of the cover P is moistened in a sufficient manner.

Immediately downstream the same side I undergoes the blowing action of the fan 58 whereby during the next advancement drippings of glue from the side are not possible.

During the downstream advancement, thanks to the inclination of the cylinders 32A the cover P is brought with its side III into contact with the conical head of the second station and the operation is identically repeated whereafter the cover P with the two opposite sides I and III already sealed passes to the stations III and IV of the apparatus, at which the application of glue onto the two other opposite sides II and IV takes places. The cover P then comes out of the apparatus in a perfectly sealed and dry condition, ready for the possible stamping and the other mailing operations. It is evident that the two application operation takes place adequately independently from the thickness of the cover P thanks to the conical shape of the applying heads.

It is moreover to be observed that in the above description specific reference has been made to single basins of glue which, however can be joined, as in the representation of the FIGS. 1–7, in only one basin extending below the plane defined by the frame 30, so that the conical heads can draw and apply glue under the same identical conditions of temperature and viscosity or fluidity.

In the same figures it is moreover shown for each station by the reference 64 a temporary stopping member for the cover to which the glue is being applied, this member consisting of a rod or plate journalled at one end to the frame 30 and controlled in a known manner to be displaced from a raised (or upwardly rotated) position, which position permits the cover to come close to the side to be glued to the corresponding a conical head, to a lowered or stopping position, in which it prevents the cover from being displaced from the desired position during the contact with the conical head and vice versa.

It is evident that the driving and control means for the displacement of the member 64 between the two indicated positions have not been represented, being conventional organs within the reach of the skilled artisan, upon their function has been individuated and clarified.

Figure 7:
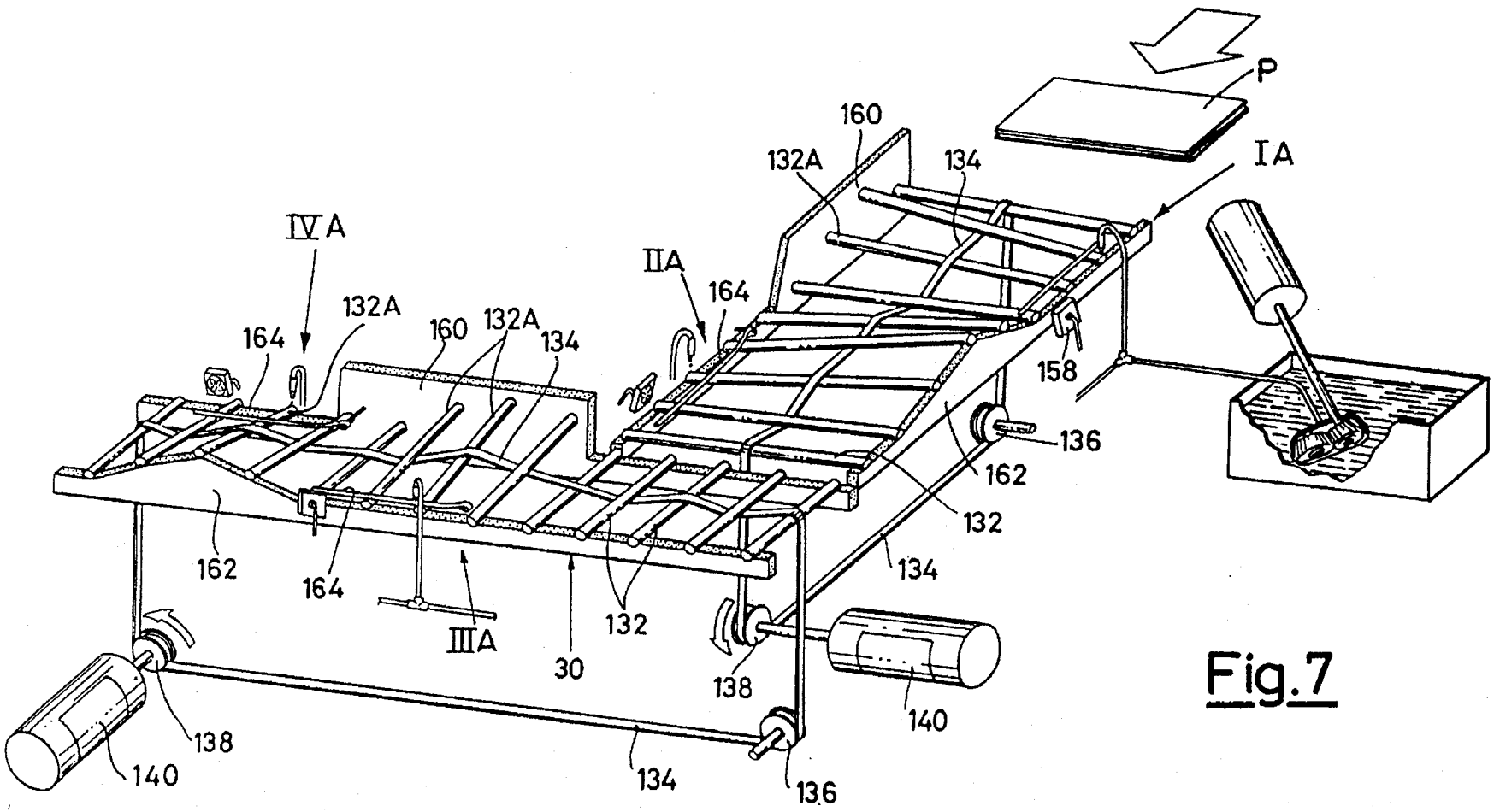
FIGS. 7 and 8 are views like FIGS. 1 and 2 respectively, showing another embodiment of the apparatus according to the invention.
Figure 8:
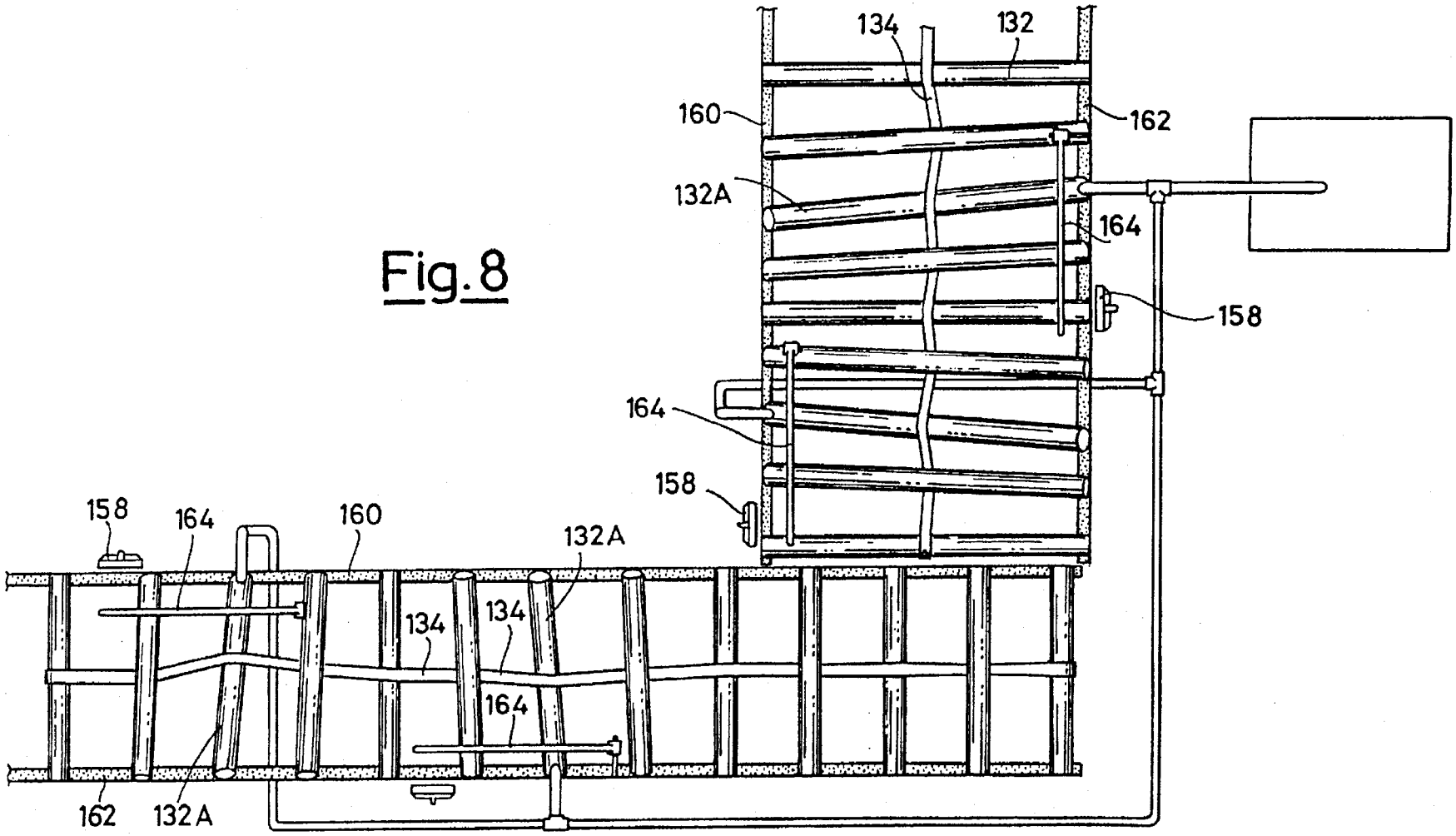

Taking now into considerations the FIGS. 7 and 8, there is shown another embodiment of the apparatus of the present invention; for sake of understanding elements which are identical or strictly similar to those of the FIGS. 1 and 3 are indicated by the same reference number increased by 100.

From the comparison between the FIGS. 7 and 8 and the corresponding FIGS. 1 and 2, it is readily appreciated from the fact that the main difference resides in the manner and in the means for the application of the glue to the four sides of the cover P. As a matter of fact in the case of the FIGS. 7 and 8 each station for the sealing by glueing is provided with a dispensing nozzle 66 connected, through a branch 68, to a conduct or suppling header 70 serving all four dispensing nozzles of the four stations and is in turn connected through a connecting duct 72 to a gear feeding pump 74, actuated from an electrical motor 76 and which draws liquid or fluidized glue 80 from a preferably thermally controlled basin 78.

The operation of the apparatus according to this embodiment is like that already described with respect to the embodiment of FIGS. 1–8 whereby it is not necessary to repeat detailedly the description of the operation.

Referring now to FIGS. 18 and 19, they relate to a further operating solution of the method according to the present invention to which reference has been made in the preamble of the specification.

As already mentioned, besides the direct application of the sealing glue in the processing phase of the paper sheet or sheets coming from the printing step, it is possible and foreseen by the present invention that the paper is pre-glued, namely provided with a seam of glue placed along the whole perimeter of each sheet, the glue, being previously applied and dried so as to permit the different operation to which the same sheet is subjected before sealing and the mailing, is reactivated for example by applying a dosed amount of heat or of thermal energy or of energy of another suitable type, whereby it is admixed with the glue of the edges of other sheets which together that being in consideration concur to form the cover to be sent or with the glue of the other edges of the same sheet when the cover is formed by only one sheet.

In this case, as it is shown in the cross section view of FIG. 19, the sheet 120 is combined with two protecting sheets, which can also be called cover sheets, 124 and 126, identical to the sheet 120 except that they are used as such, or to print thereonto only the address of addressee and the data of the sender.

By the reference 128 there is indicated and shown on enlarged scale the sealing seam which is provided all around the cover formed from the three sheets 120, 124 and 126 and resulting from the melting and solidification of the seams 122 of which each sheet 120 is provided.

It is also foreseen and foreseeable that instead of three sheets they are reduced to only two sheets, in the sense that the sheet 120 is also acting as a cover sheet by its back face.

Of course the sheets 120 can be greater as to their number and in that case the sealing seam 120 extends for the whole thickness of the resulting cover.

When the latter is of very great thickness it is possible and foreseen by the present invention that the sealing seam 128 is reinforced by an additional member, for example a paper or tissue ribbon or another member having a similar function as it occurs for example in the case of the book binding ribs for books.

Figure 20:
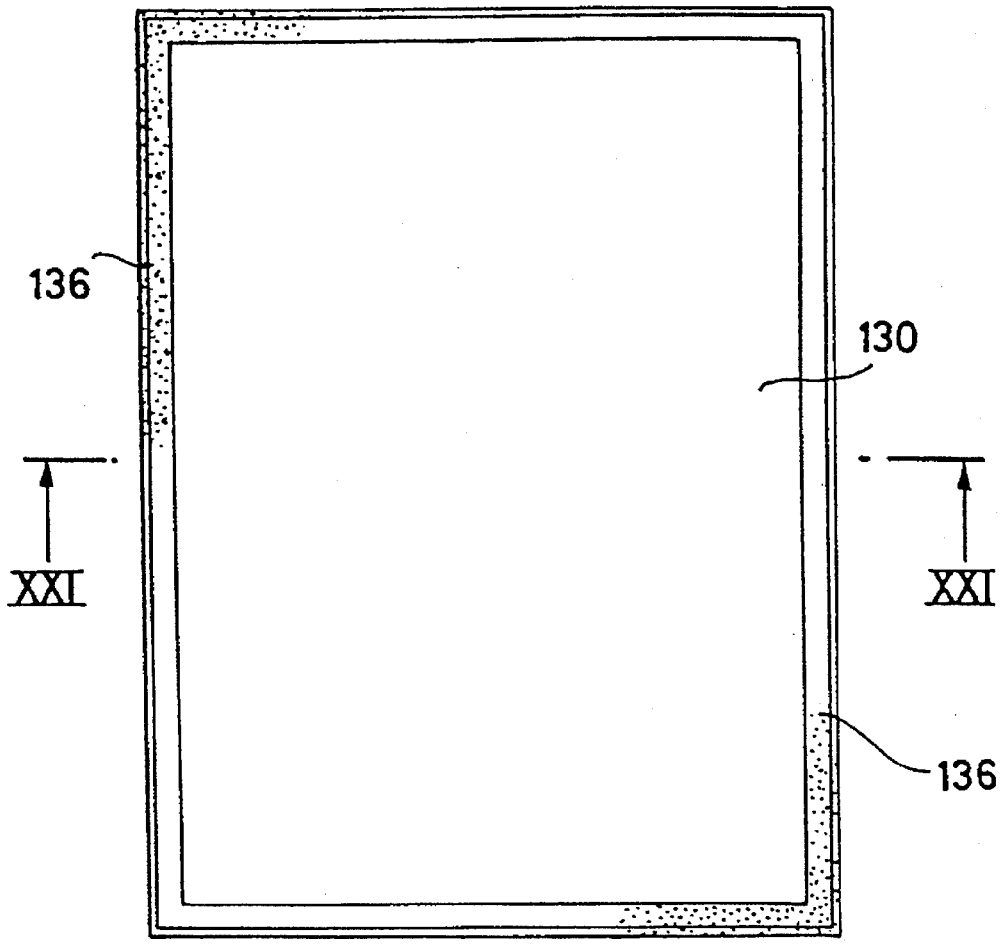
Figure 21:
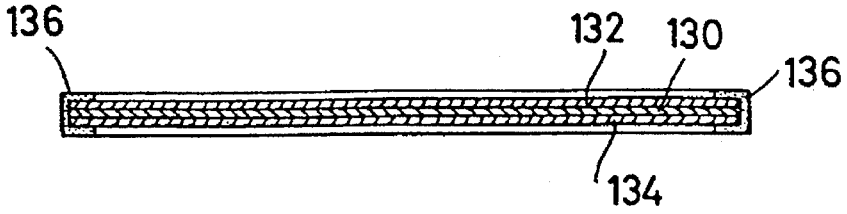

In this connection and as a further variation (see FIGS. 20 and 21 ), the sheet cover (represented by the reference numbers 130, 132 and 134, the latter acting as cover sheets) is enclosed at all its perimetral edges by a U-shaped member 136, glued to the same edges of the sheets in the same manner as the sealing seam 128 of FIG. 19. The member 136 is preferably a ribbon having a certain flexibility and previously U-shaped, even if the U-shape can be given to the ribbon at the time of parcel sealing.

In the above description reference is constantly made to the glues and to the glueing there being obviously meant glues suitable for paper supports.

Since this type of glue is well known in this art (it is enough to take it into consideration the glues already used in the normal envelopes, both of reversible and of non reversible type, or those presently used for the pre-glueing of the so called self-enveloping forms) the skilled artisan shall be enabled to easily make his choice without need of particular teaching.

Even in the case of the FIGS. 18, 19 and 20, 21, the operations of sealing of glueing already described with respect to the previous embodiments are identically repeated, except that instead of the device for the application of liquid or fluid glue drawn from a thermally regulated device there will be used means for the activation of the glue forming the edge seam of each sheet, such as for example conical heads as those shown in the FIGS. 1 and 2 or even cylindrical rollers suitably heated and thermally controlled; by the way in this case the glue must be of the type which can be activated by heat.

The invention has been described with reference to preferred embodiments thereof, it being meant that modifications and variation, which are conceptually and mechanically equivalent, are possible and foreseeable without coming out of the scope thereof.

I claim:

1. A method for sealing a mailer formed from at least one sheet, said method comprising the steps of:

providing at least one sheet, each said at least one sheet having an obverse face, a reverse face and four outer perimeter edges;

providing at least one fold line on said at least one sheet, to divide said sheet into at least two parts, said at least two parts being substantially equal to one another;

folding said at least one sheet along said at least one fold line so that portions of said edges are aligned and said at least two parts are in a flat, superimposed configuration in which said aligned edges and said at least one fold line form four sides defining the perimeter of the folded at least one sheet and so that said obverse face of said at least one sheet is unexposed;

applying a glue solely to all of the four sides along the entire perimeter of the folded at least one sheet to maintain said edges in said aligned condition and thereby provide a mailer which is completely closed on all sides.

2. The method of claim 1, wherein said at least one fold line is a transverse fold line extending in a direction between two of the edges of the least one sheet and is substantially perpendicular to a major length of the least one sheet said transverse fold line dividing the at least one sheet into a first part and a second part which are two parallel and contiguous zones each having a predetermined size.

3. The method as claimed in claim 2, further comprising the steps of:

providing a first sheet and a second sheet;

overlaying the first sheet onto the second sheet so that a reverse face of said first sheet overlies an obverse face of the second sheet with all four edges of said first and said second sheet coinciding with each other;

folding said first and said second sheets along at least one fold line so that an obverse face portion of said first sheet on one side of the said fold line overlies an obverse face portion of said first sheet on the other side of said fold line.

4. The method as claimed in claim 1, further comprising the steps of:

providing a first sheet and a second sheet;

overlaying the first sheet onto the second sheet so that a reverse face of said first sheet overlies an obverse face of the second sheet with all four edges of said first and said second sheet coinciding with each other;

folding said first and said second sheets along at least one fold line so that an obverse face portion of said first sheet on one side of the said fold line overlies an obverse face portion of said first sheet on the other side of said fold line.

5. A method for sealing a mailer of at least two sheets of the same configuration, wherein each of said at least two sheets has two faces and an outer perimeter edge surrounding said two faces, comprising the steps of:

aligning said at least two sheets together so that the outer perimeter edges of said at least two sheets coincide;

applying glue solely to said coincided outer perimeter edges along the entire perimeter so that a mailer is produced which is completely closed on all said sides.

6. The method of claim 5, wherein a sheet of said at least two sheets has printing applied thereto at a high operational rate by laser printers and which requires folding along predetermined lines said method further comprising the steps of:

after the aligning step but prior to the glue applying step, folding said at least two sheets along at least one cross folding line so that portions of said outer perimeter edges are aligned and so that said aligned edge portions with the at least one folding line form four sides, said sides defining the perimeter of the folded at least two sheets; and applying said glue solely to said sides along the entire perimeter of the folded at least two sheets to provide said mailer which is completely closed all said sides.

7. The method according to claim 6, further comprising, in the folding step, folding along two equally spaced cross-folding lines to provide the folded at least two sheets with at least three parts having aligned edge portions.

8. The method according to claim 6, wherein each of said at least two sheets has four edges and a major length, wherein;

said at least one fold line is perpendicular to two of said four edges and to the major length of said coincided at least two sheets and forms at least two parallel and contiguous zones in said at least two sheets; and said folding causes said at least two parallel and contiguous zones to over lie one another.

9. The method according to claim 5, further comprising, after the aligning step, providing two equally spaced cross-folding lines to divide said at least two sheets into three parts;

folding said at least two sheets in a Z-fold or W-fold configuration along said two equally spaced cross-folding lines so that portions of said outer perimeter edges are aligned and so that said aligned edge portions with the at least two folding lines form four sides, said sides defining the perimeter of the folded at least two sheets; and applying said glue solely the sides of along the whole perimeter of the folded at least two sheets to provide said mailer which is completely closed on all said sides with at three parts and two substantially equal outer faces.

10. The method according to claim 5, wherein said outer perimeter edge of said at least two sheets consists of four edges, the method further comprising;

after the aligning step, providing at least one fold line to divide said at least two sheets into at least two parallel and contiguous zones;

folding said at least two sheets along said at least one fold line perpendicular to two of said four edges to have the parallel and contiguous zones overlie each other so that portions of said outer perimeter edge are aligned and so that said aligned edge portions with the at least two folding lines form four sides, said sides defining the perimeter of the folded at least two sheets; and applying said glue solely to the sides along the entire perimeter to seal the two parallel and contiguous zones together along the sides of the folded at least two sheets to form a mailer which is closed on all sides.

* * * * *